US006921222B2

(12) United States Patent
Ng et al.

(10) Patent No.: US 6,921,222 B2
(45) Date of Patent: Jul. 26, 2005

(54) OVERALL SYSTEM DESIGN AND LAYOUT OF AN ON-DEMAND LABEL/TAG PRINTER USING INKJET TECHNOLOGY

(75) Inventors: Keng Leong Ng, Singapore (SG); Kok Hong Kan, Singapore (SG); Yong Soon Lim, Singapore (SG); Siao Hau The, Singapore (SG); Chi Siang Sean Yew, Singapore (SG); Chee Weng Wong, Singapore (SG); Chee Seng Ong, Singapore (SG)

(73) Assignee: Venture Manufacturing (Singapore) Ltd., Singapore (SG)

( * ) Notice: Subject to any disclaimer, the term of this patent is extended or adjusted under 35 U.S.C. 154(b) by 0 days.

(21) Appl. No.: 10/236,576

(22) Filed: Sep. 6, 2002

(65) Prior Publication Data

US 2004/0156665 A1 Aug. 12, 2004

Related U.S. Application Data

(60) Provisional application No. 60/318,068, filed on Sep. 7, 2001.

(51) Int. Cl.[7] ..... B41J 15/16; B65H 23/182; B65H 23/188; B65H 23/192

(52) U.S. Cl. ..... 400/618; 400/613

(58) Field of Search ..... 400/611, 613, 400/613.3, 618

(56) References Cited

U.S. PATENT DOCUMENTS 3,816,652 A * 6/1974 Barnett ..... 358/409
6,033,067 A 3/2000 Kakizaki et al.
2004/0141020 A1 * 7/2004 Kanda et al. ..... 347/15

FOREIGN PATENT DOCUMENTS

| | | | | |
|---|---|---|---|---|
| EP | 582851 A1 * | 2/1994 | ..... | G03B/27/58 |
| EP | 0 891 870 A2 | 1/1999 | | |
| EP | 0 891 870 A3 | 9/1999 | | |
| JP | 10035966 A * | 2/1998 | ..... | B65H/23/182 |
| JP | 2000 263877 | 9/2000 | | |
| JP | 2000 007199 | 11/2000 | | |
| JP | 2002226103 A * | 8/2002 | ..... | B65H/23/10 |
| WO | WO 99/47354 | 9/1999 | | |
| WO | PCT/ISA/206 | 12/2002 | | |
| WO | PCT/SG02/00214 | 3/2003 | | |

OTHER PUBLICATIONS

Machine translation of JP 10–35966 to Tsunekawa et al. from Japanese Patent Office website.*
Machine translation of JP 2002–226103 to Yoshida et al. from Japanese Patent Office website.*

* cited by examiner

*Primary Examiner*—Daniel J. Colilla
(74) *Attorney, Agent, or Firm*—Daniel B. Schein, Esq.

(57) ABSTRACT

A high-speed printer is provided. The printer includes a media assembly for supporting a media roll that supplies the sheet of media and also for controlling a flow rate of the sheet of media through the printer. The sheet of media is received by the feedback control system, which is used to detect a slack position of the sheet of media. The slack position is used by the media assembly to determine a flow rate of the sheet of media through the printer. In addition, the printer also includes a roller system for receiving the sheet of material from the feedback control system and to feed the sheet of media to a print carriage.

9 Claims, 9 Drawing Sheets

OVERALL SYSTEM DESIGN AND LAYOUT OF AN ON-DEMAND LABEL/TAG PRINTER USING INKJET TECHNOLOGY

This application claims the benefits of U.S. Provisional Application No. 60/318,068 filed Sep. 7, 2001.

BACKGROUND OF THE INVENTION

1. Field of the Invention

The present invention relates generally to media handling for high output printer. More particularly, the present invention relates to a method and apparatus for handling media, and therefore minimizing the downtime of the printer, preventing paper or media jams, and maximizing output.

2. Description of the Related Art

Inkjet printers typically include a media advancing assembly and a print head that repeatedly moves in a path that is transverse to the direction of the advancing media. After every pass of the print head, the media advances a distance equal to the width of a print swath. A microprocessor, which sends signals to a drive mechanism for a media feed roller, is used to control the direction and amount of media travel. In response to control signals from the processor, the feed roller rotates a predetermined amount. The feed roller and a set of pinch rollers pinches and feeds the media an amount desired for printing, cutting and/or other operations.

The carriage of the inkjet printer usually includes a set of print heads, with each print head representing a different color to be applied to the media, e.g. cyan, magenta, yellow, and black. To enable printing millions of colors, two or more of the nozzles may be directed to deposit ink at the same location on the media or the nozzles may be directed to deposit ink at a precise location with respect to deposits from other nozzles. Therefore, the accuracy of media advancement is of prime importance to the quality of the resulting printout. Under-advancement of the media will cause the print swaths to overlap, while over-advancement of the media will cause the print swaths to be separated.

Inkjet printers are particularly important for printing in color on labels because other color label printers are much more expensive. For example, the consumable materials that are required for a thermal color printer are much more expensive than the materials used in a color inkjet printer. Unfortunately, the performance of inkjet printers leaves much to be desired. A typical home or office inkjet printer is limited to a slow rate of printing because the printer is unable to feed media through itself at a high rate without causing media handling problems, such as media slippage.

These problems are well documented in the on-demand label/tag printing industry. In the label printing industry, the printing media is normally either in the form of a continuous roll or continuous folded stack of labels/tags. Prior to printing, the media from the roll or stack is typically fed through the printer until a forward edge of the media exits the feed roller at a position under the print head. In most instances, the pinch rollers must be released from the feed roller to ensure that the media can be loaded without obstruction. Once the media is loaded, the pinch rollers are lowered to thereby "pinch" or compress the media against the feed roller.

As is well known in the industry, printer operation is often interrupted when the printer runs out of paper, ink or toner, and needs to be re-supplied. A home or office user is generally able to tolerate the interruption and the resulting lower throughput. For example, if an office user needs to refill the printer with paper before completing, it is usually considered an inconsequential delay. This is because the utilization time of a home or office printer is not very high, i.e. the printer is often left idle. However, for applications such as the continuous mass printing of labels or tags where the utilization time of the printer is very high, delays to refill the printer with ink, paper, or media will dramatically lower throughput. Therefore, it is important to reduce not only the length of each interruption, but also the number of interruptions to the operation of a printer.

A further problem arises when the media is subjected to a series of interruptions or discontinuous start/stop cycles during printing. As the feed roller rotates through cycles of high acceleration and deceleration for every print swatch, the sudden pull of the media at the beginning of a cycle together with the back tension on the media may result in media slippage, particularly if the pinch pressure is insufficient. The issue of media slippage is even more pronounced with the much higher throughput requirements of inkjet printers designed for the high-speed printing industry in comparison to printers designed for typical home or office use. In addition, the greater inertia caused by using a large roll of media only exacerbates the slippage problem.

For example, in the high-speed label printing industry, it is highly advantageous to maximize the size of each individual roll of labels as well as to maximize the speed of the printing by pulling a sheet of labels from the roll through the printer as quickly as possible. The larger the roll that can be handled by the printer, the less the downtime suffered. Unfortunately, an increase in the size of the roll of media also increases the weight that must be pulled by the feed and pinch rollers. The increase in weight also increases the chances that the media will slip from one of the rollers and create a jam. In addition, each time the printer stops printing, the rollers must overcome great inertia to restart the printer and resume printing at a high speed. This is particularly true for inkjet printers, which are subject to more start/stop cycles than other printers.

Similar problems plague other media handling tasks that may interrupt the operation of the printer. These tasks include accommodating varying media dimensions and sizes, loading new media rolls (particularly in label printing applications), and guiding the media through the printer, (i.e. keeping the paper straight as it is being fed through the printer). Dealing with each case typically requires the printer to cease operation before the proper maintenance may be performed.

In view of the foregoing, it is desirable to have a method and apparatus providing for a high output inkjet printer. In particular, it is desirable to have a method and apparatus to handle and guide a large roll of media of varying dimensions and thickness through the high-speed printer with minimal slippage. In addition, it is desirable to be able to re-supply the printer with a new roll of media with minimal difficulty.

SUMMARY OF THE INVENTION

The present invention fills these needs by providing media handling for high output printers. It should be appreciated that the present invention can be implemented in numerous ways, including as a process, an apparatus, a system, a device or a method. Several inventive embodiments of the present invention are described below.

In one embodiment of the present invention, a high-speed printer is provided. The printer includes a media assembly for supporting a media roll that supplies the sheet of media and also for controlling a flow rate of the sheet of media through the printer. The sheet of media is received by the feedback control system, which is used to detect a slack position of the sheet of media. The slack position is used by the media assembly to determine a flow rate of the sheet of media through the printer. In addition, the printer also includes a roller system for receiving the sheet of material from the feedback control system and to feed the sheet of media to a print carriage.

The feedback control system preferably includes a tensioner having a first end coupled pivotably to a base of the printer and a second end coupled to the sheet of media. The tensioner is preferably pivotable around said base to move the second end and the sheet of media to the slack position. The system also preferably includes a codewheel having a number of markings coupled to the first end of the tensioner. The markings include a lowered marking, a neutral marking, and a raised marking that correspond to the position of the sheet of media. A sensor coupled to the base detects the markings and therefore the position of the media. Depending on the marking detected, the media assembly is able to control the flow rate of the media sheet, including increasing or decreasing the flow rate of the media sheet, stopping the flow, or reversing the flow rate to a negative flow rate.

In another embodiment of the present invention, a method for handling media in a high-speed printer is provided. The method begins by providing a media roll that is used to supply a sheet of media. The media sheet is fed into a print carriage for printing. A slack position of the sheet of media is detected. The slack position is preferably initialized to a neutral position after initialization, but changes immediately after printing has begun to a raised position. A flow rate of the sheet of media through the printer is then controlled based on the slack position of the sheet of media. The higher the raised position, the higher the flow rate will be increased. If printing is stopped, then the flow rate will be stopped. If there is excess slack in the sheet of media, the flow rate is preferably controlled to a negative flow rate, thereby retracting the media sheet back into the media roll.

In yet another embodiment of the present invention, a high-speed inkjet printer is provided. The printer includes a media assembly for supporting a media roll for supplying a sheet of media. The printer also includes a roller system for receiving the sheet of media from the media assembly system and for feeding the sheet of media to a print carriage. A platen is used to support the sheet of media during printing from the print carriage. The platen is movable to adjust a pen to paper spacing between the sheet of media and the print carriage by a cam system, which includes a set of cams. The cams are coupled to the platen to raise and lower the platen when the cams are rotated. A lever coupled to one of the cams enables a user to manually adjust the pen to paper spacing to preferably about 1.3 mm.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings. To facilitate this description, like reference numerals designate like structural elements.

DETAILED DESCRIPTION OF THE PREFERRED EMBODIMENTS

A method and apparatus for media handling in a high output printer is provided. In the following description, numerous specific details are set forth in order to provide a thorough understanding of the present invention. It will be understood, however, to one skilled in the art, that the present invention may be practiced without some or all of these specific details. In other instances, well known process operations have not been described in detail in order not to unnecessarily obscure the present invention.

Figure 1A:
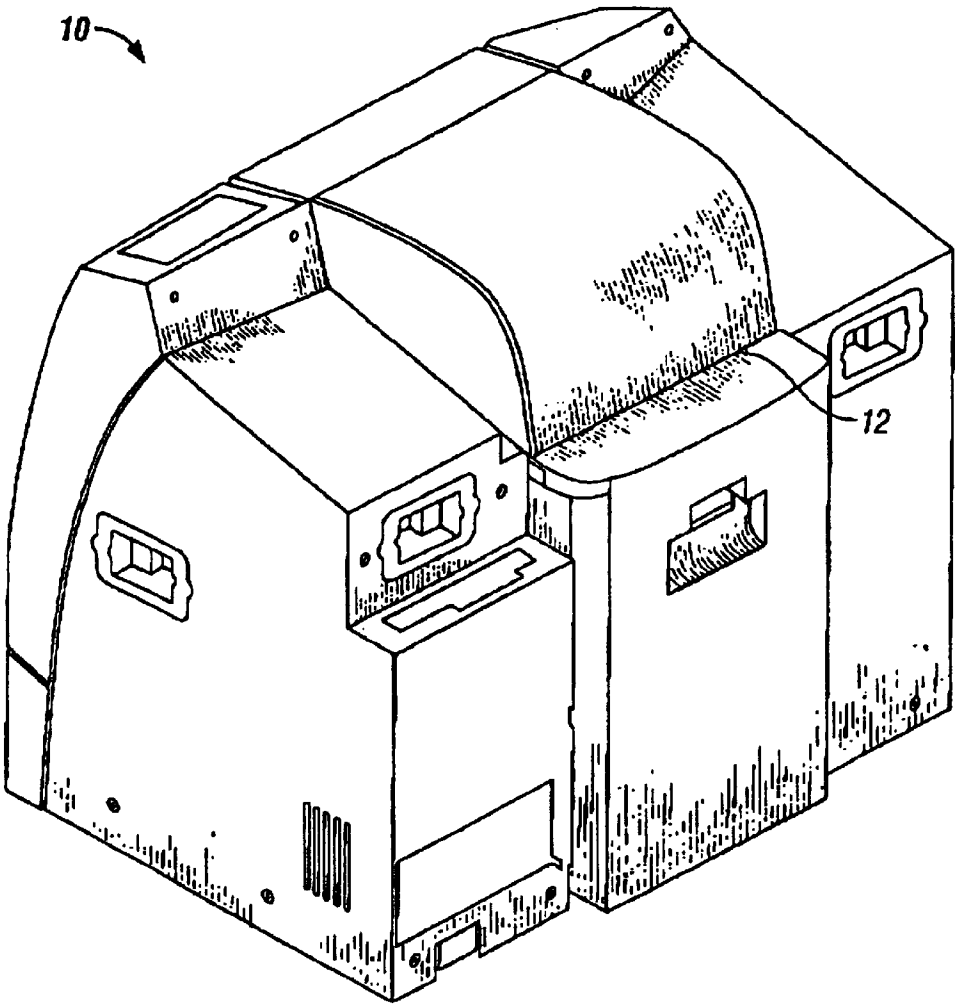
FIGS. 1A–1B illustrate an external and an internal view of a high output printer in accordance with one embodiment of the present invention.
Figure 1B:
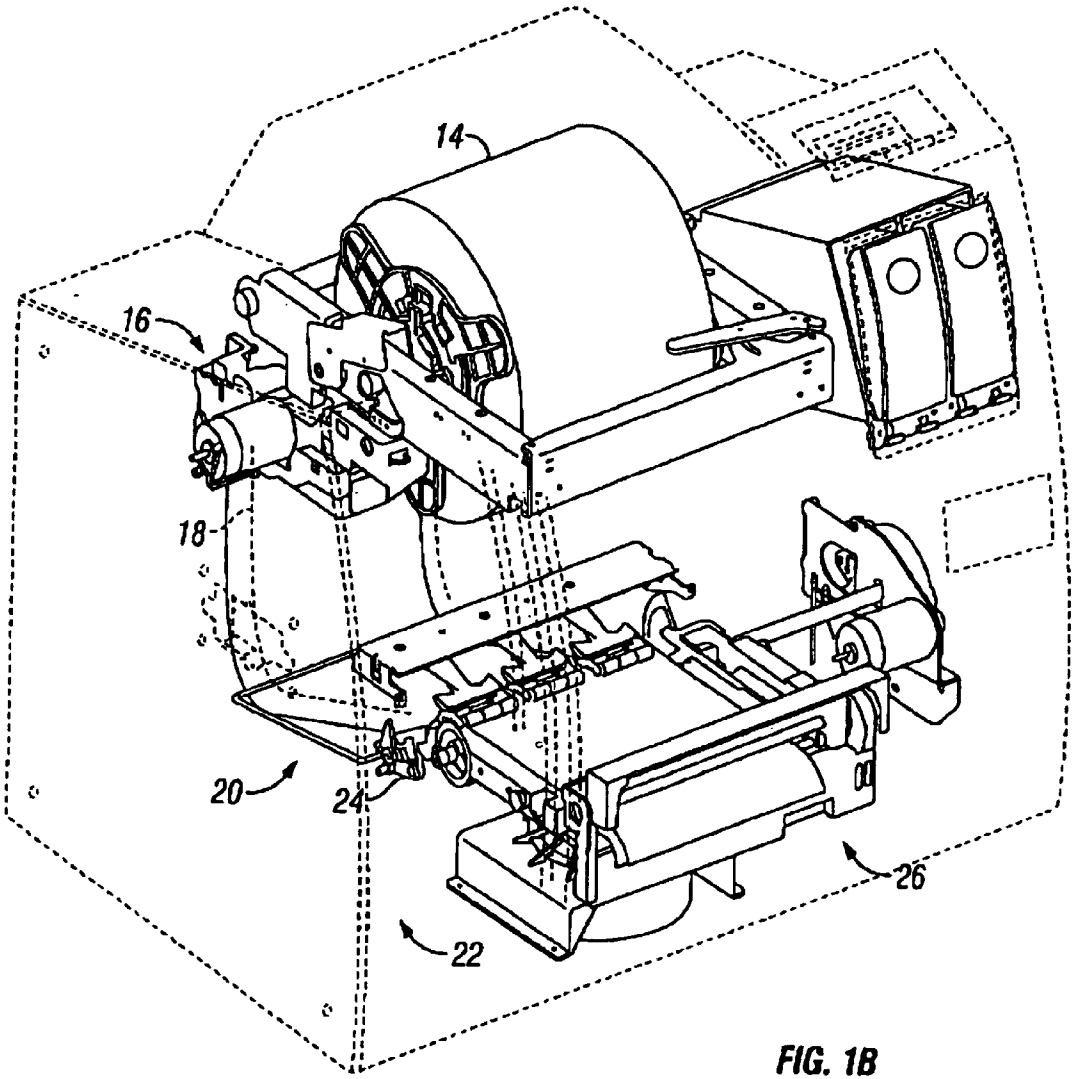

FIGS. 1A–1B illustrate an external and an internal view of a high output printer 10 in accordance with one embodiment of the present invention. In this particular embodiment printer 10 is a high-speed inkjet label printer manufactured by Venture Manufacturing Ltd. High-speed inkjet label printer 10 typically includes a hatch 12, which is closed during normal printer operation (as illustrated). A roll of media 14 is located beneath hatch 12 and supported by a media assembly 16. Hatch 12 may be opened to access the interior of printer 10. Hatch 12 is typically opened to insert a new media roll 14 for printing.

A sheet of media 18 originating from roll of media 14 is fed through a feedback control system 20 and a roller system 22 before being guided to a platen 22 for printing. Although, reference numeral 18 is used to refer to a media sheet, a person of skill in the art will appreciate that the media is represented by a continuous sheet that is unraveled from media roll 14. The length of media sheet 18 is dependent upon the size of media roll 14 and is typically from about X meters to about Y meters long.

Feedback control system 20 monitors the amount of media being printed before sending a signal to media assembly 16 to release more media from media roll 14. As more media is released, roller system 22 is used to physically grip media sheet 18 and guide it to platen 24. After media sheet 18 is placed over platen 24, a cam system 26 may be used to regulate the distance between media sheet 18 and a print carriage. One of the features of cam system 26 is that it is easily adjustable so that it is able to accommodate varying media thicknesses and dimensions.

Figure 2A:
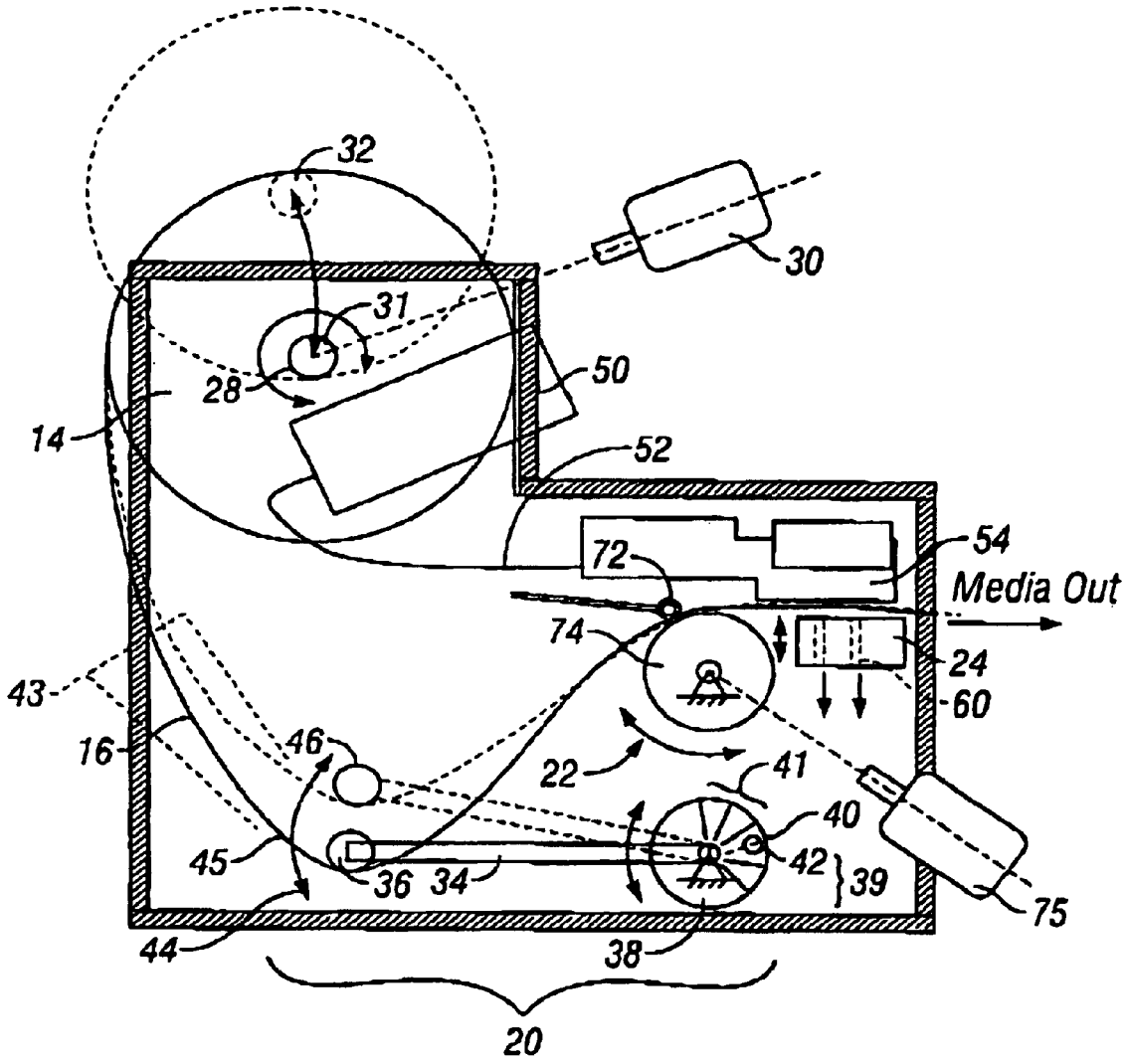
FIGS. 2A–2B are side views of high-speed inkjet label printer in accordance with one embodiment of the present invention.
Figure 2B:
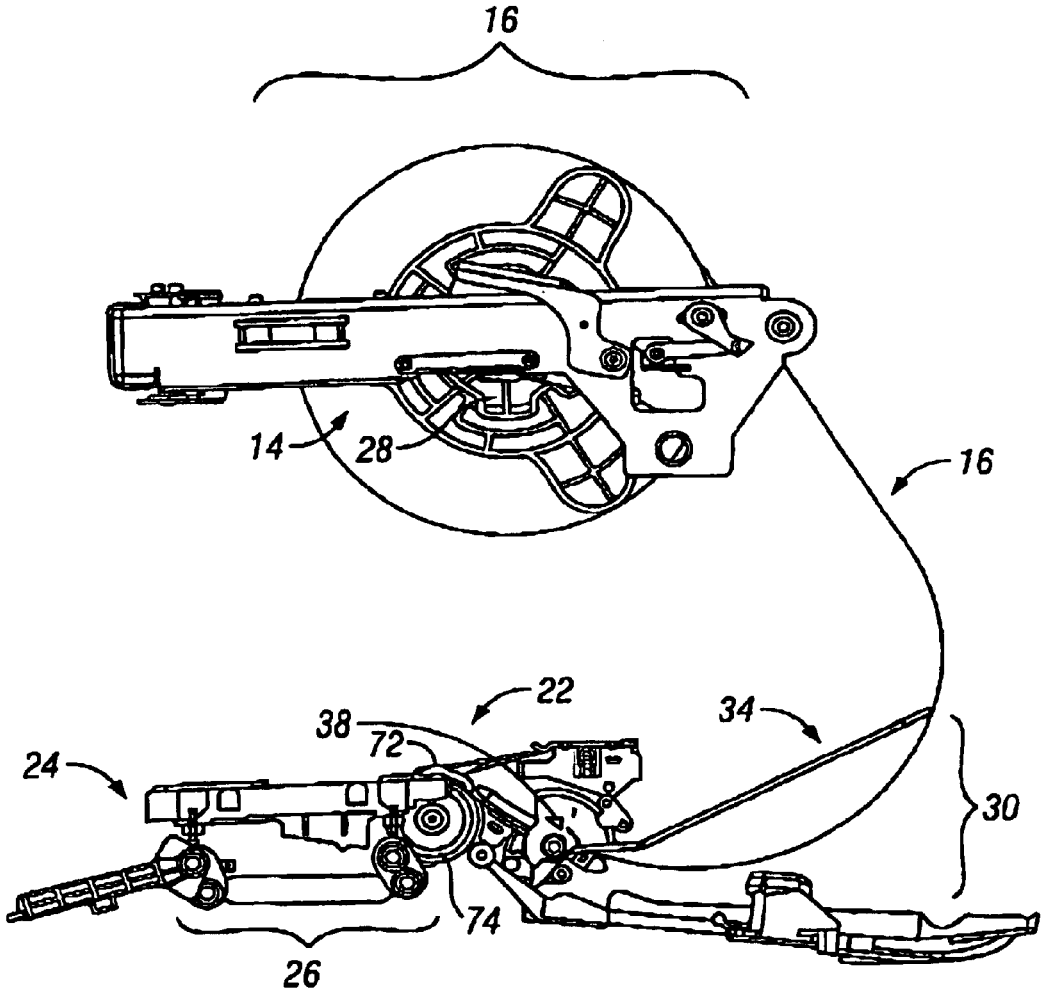

FIGS. 2A–2B are side views of high-speed inkjet label printer 10 in accordance with one embodiment of the present invention. As described above with respect to FIGS. 1A and 1B, printer 10 includes media assembly system 16, feedback control system 20, roller system 22, and cam system 26. Each of these systems ensures that media sheet 18 is guided precisely through printer 10 at a high speed for printing and at a proper distance away from a print carriage. Each system therefore ensures that printer 10 experiences minimal downtime from maintenance activities, such as fixing a media jam caused by media slippage.

Media assembly 16 includes a media reel 28 for holding media roll 14, which may be turned by a reel motor 30. Media reel 28 is movable between a loading position 32 (when hatch 12 is open) and a printing position 31. Feedback control system 20 includes a tensioner 34 having a first end that is pivotably coupled to a base (not illustrated), which is simply a non-moving part of printer 10, such as the housing of printer 10. Tensioner 34 also includes a second end for supporting a roller 36. A codewheel 38 having a set of slack markings 39, a neutral marking 40, and a set of raised markings 41, is coupled to the first end of tensioner 34. An optical sensor 42 is mounted on the base and electrically coupled to a microprocessor (not illustrated) that controls the operation of reel motor 30 of media reel 28. Sensor 42 is used to detect markings 39, 40, and 41.

One of the purposes of feedback control system 20 is to form a buffer between media assembly 16 and roller system 22. In traditional printers, roller system 22 would be used to pull media sheet 18 font media roll 14, which would result in the rotation of media roll 14. However, because it is desirable to print at higher speeds as well as to increase size of media roll 14, feedback control system 20 is used to create a slack in media sheet 18 to prevent media back tension between media assembly 16 and roller system 22. This is important because the back tension typically increases chances of media slippage, which will lead to a lower quality of printing.

Media sheet 18 is guided through a funnel 43 and under roller 36 at the second end of tensioner 34, both of which are movable between a number of slack positions, including a number of lowered positions 44, a neutral position 45, and a number of raised positions 46. After the printer has been initialized, the slack position of media sheet 18 is neutral position 45. When the printer begins operation, media sheet 18 will be pulled by roller system 22 for printing before being output from printer 10. The length of media sheet 18 between media roll 14 and roller system 22 will therefore be shortened, moving the second end of tensioner 34 to one of raised positions 46.

As the second end of tensioner 34 rises, tensioner 34, codewheel 38, and markings 39, 40, and 41 all rotate in a clockwise manner. After a rotating, one of raised markings 41 will appear within the view of sensor 42. When this occurs, sensor 42 sends a media release signal to media assembly 16 through the microprocessor. Reel motor 30 then turns media reel 28, releasing more media from media roll 14. If media is not being released quickly enough, the second end of tensioner 34 will continue to rise. This results in the sensing of subsequent raised markings 41 by sensor 42 and the transmission of signals to media assembly 16 to release media at an even faster flow rate for each of markings 41 detected.

When the release of media outpaces the amount of media being used, the second end of tensioner 34 will begin to lower back towards neutral position 45. This results in the counterclockwise turning of tensioner 34, codewheel 38, and markings 39, 40, and 41. Because each of markings 39, 40, and 41 are associated with a certain rotation and speed of reel motor 30, the speed of reel motor 30 will decrease, lowering the flow rate of media sheet 18. When the second end of tensioner 34 returns to neutral position 45, media assembly 16 stops releasing media.

In cases where the media slack has become too large (such as when media sheet 18 is pushed back into printer 10), the second end of tensioner 34 may drop into lowered position 44, resulting in the detection of markings 39 by sensor 42. In this scenario, sensor 42 transmits a signal to reel motor 30 to turn media reel 28 in the opposite direction, thus retracting media sheet 18 back into media roll 14 and creating a negative flow rate. As media sheet 18 is retracted, the second end of tensioner 34 will move back to neutral position 45) which results in the detection of neutral marking 40 by sensor 42 and the stopping of reel motor 30. Feedback control system 20 may thus be used to sense the amount of media required for printing and control media assembly 16 to generate the proper flow rate to feed media sheet 18.

The combination of a motorized media reel coupled to feedback control system 20 enables printer 10 to operate at a high-speed while minimizing the chances of media slippage and any resulting media jam. Continuity of operation is also greatly increased because the mechanism also enables the use of a much larger and heavier roll of media than that used in traditional printers. As described above, increasing the utilization time while reducing the number of interruptions in the operation of printer 10 is extremely important and desirable. The present invention therefore enables inkjet printer 10 to print from about four to about five inches per second of black and white printing and about two inches per second of color printing.

Additionally, printer 10 also includes a number of other features including an ink distribution system 48 having a set of ink bottles 50 coupled to an ink conduit 52, which is then coupled to print carriage 54. Ink flows from ink bottles 50 aided by the pull of gravity through ink conduit 52 to print carriage 54. For ease of illustration, only one ink bottle is illustrated, however many additional ink bottles may be installed within printer 10. Each of ink bottles 50 is easily installed and removed, enabling a user to easily re-supply printer 10 with ink.

Figure 3:
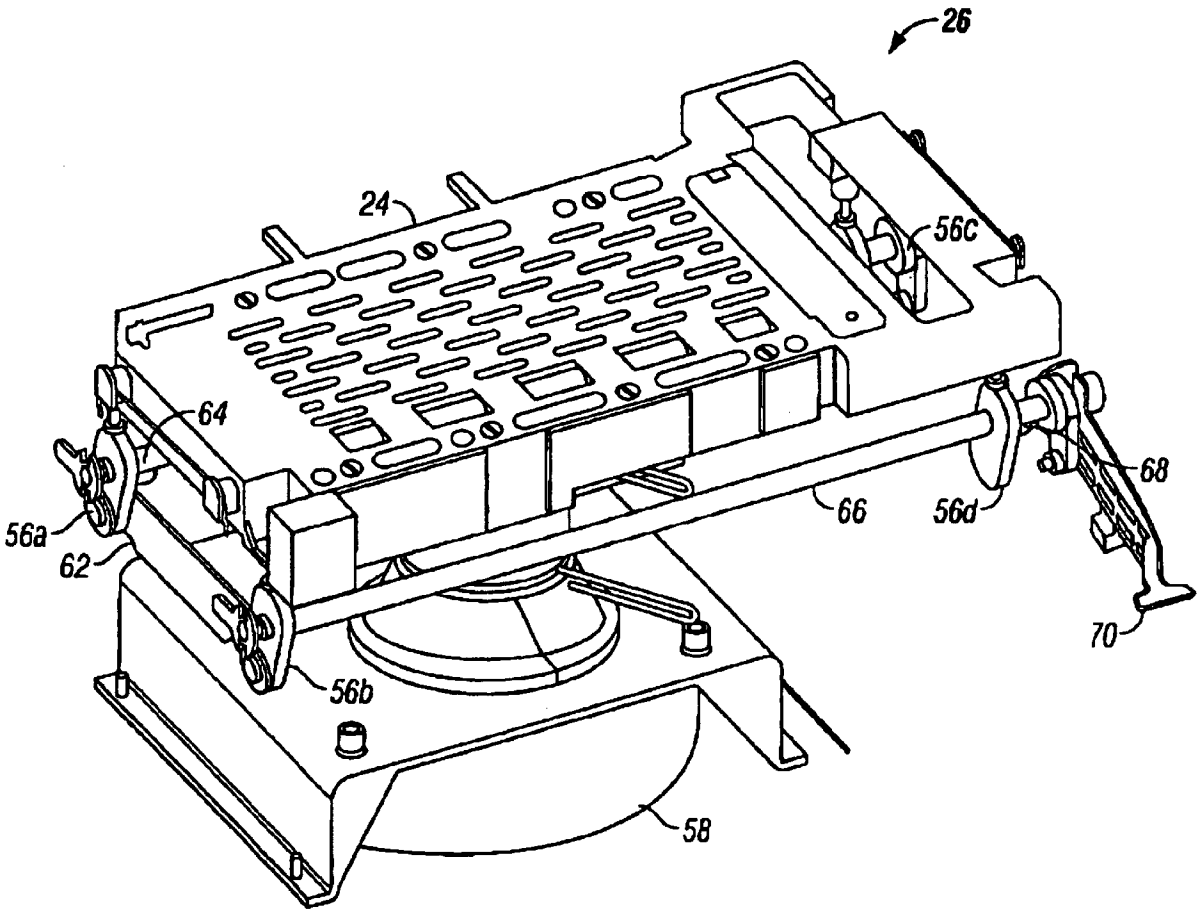
FIG. 3 illustrates the cam system in accordance with one embodiment of the present invention.

FIG. 3 illustrates cam system 26 in accordance with one embodiment of the present invention. Cam system 26 includes a set of cams 56*a–d*, which is coupled to platen 24. A fan 58 is coupled to platen 24, which also includes a number of apertures 60 that enable air to flow between the top of platen 24 through fan 58. Cam 56*a* is coupled to cam 56*b* through a first link 62 and to cam 56*c* through a first rod 64. Cam 56*d* is coupled to cam 56*b* through a second rod 66 and to cam 56*c* through a second link 68. Cam 56*d* is also coupled to a lever 70, which may then be used to operate all of cams 56*a–d* simultaneously.

When a media sheet is pulled over platen 24, it must be secured to platen 24 while maintaining an accurate distance from print carriage 54 to enable accurate printing. This distance is also known as pen to paper spacing (PPS). In conventional printers, a pivotable print carriage is used to set the PPS. However, a different solution is required in high-speed inkjet printers because the print carriage is much larger than normal size (which is about ¼ to about ½ inches in width). The large print carriage (preferably about at least two inches in width) of the present invention ensures a high printing speed, but also eliminates the use of a pivotable print carriage to set PPS.

In the present invention, the PPS is adjusted firstly by cam system 26, which may be used to move platen 24 up and down to change the PPS, depending on the media's thickness. Platen 24 is moved either up or down by manually moving lever 70 up or down. The distance that platen 24 may be moved is preferably at least 0.8 millimeters. Media used by printer 10 is typically between about eight mils to about twelve mils in thickness, which is easily accommodated by cam system 26. Secondly, fan 58 may be used to create a vacuum between platen 24 and the media through apertures 60. The vacuum suctions the media to the surface of the top of platen 24, thereby ensuring that the media is held down securely and runs flat along the top of platen 24.

Figure 4:
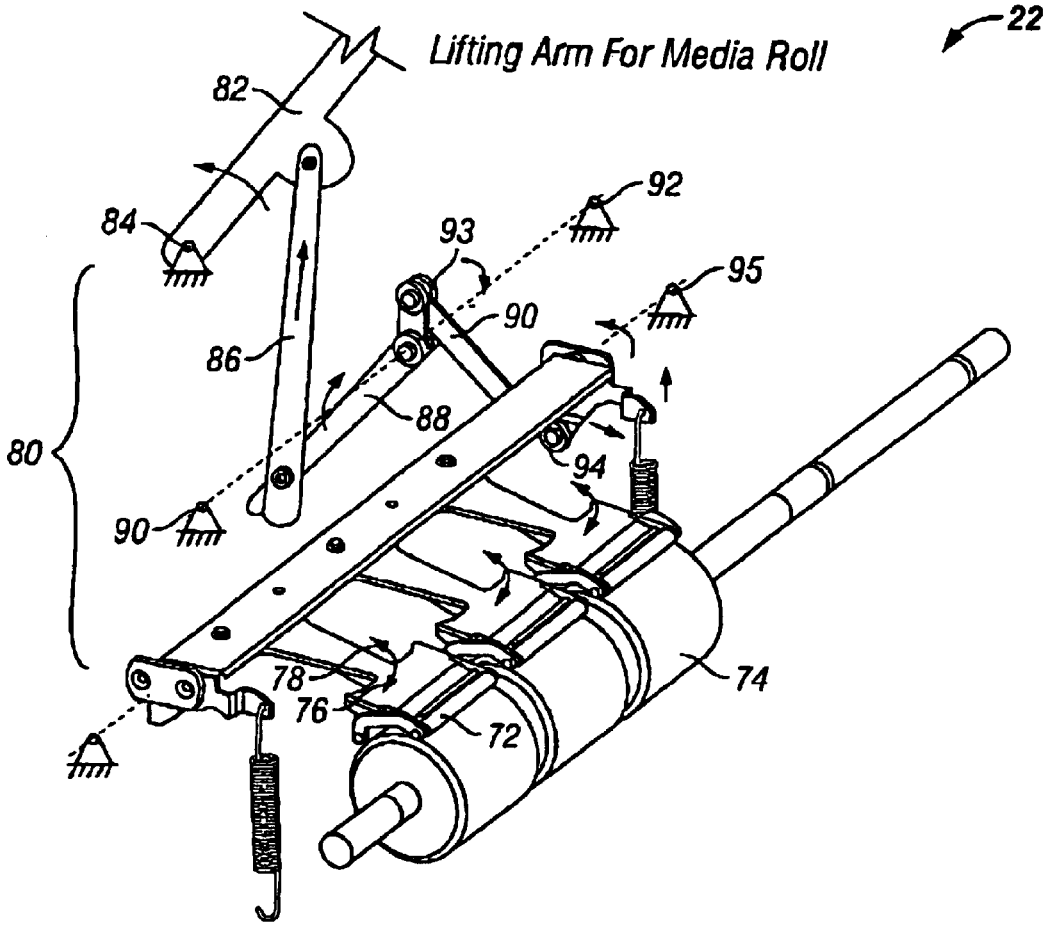
FIG. 4 illustrates the roller system in accordance with one embodiment of the present invention.

FIG. 4 illustrates roller system 22 in accordance with one embodiment of the present invention. Roller system 22 includes a pinch roller 72, which pinches on a feeder roller 74 when in an engaged position 76. Feeder roller 74 includes a roller motor 75 (illustrated in FIG. 2A) for rotating feeder roller 74. Pinch roller 72 is movable between engaged position 76 and a disengaged position 78. Roller system 22 also includes a linkage assembly 80, which includes a first bar 82 having a first pivot point 84. First bar 82 is also coupled to a second bar 86, which is pivotably coupled to a third bar 88. Third bar 88 is coupled to a fourth bar 90 at pivot points 92 and 93. Fourth bar 90 is then coupled to pinch roller 72 at a pivot point 94.

When a new media roll is installed into printer 10, a user accesses media reel 28 by opening hatch 12 and moves media reel 28 to loading position 31. After a new media roll has been installed, hatch 12 is closed and media reel 28 is moved to printing position 32. Linkage system 80 facilitates the loading of new media into printer 10 by raising pinch roller 72 to disengaged position 18, whenever media reel 28 is moved to loading position 32. First bar 82 is pulled upwards by the rising movement of media reel 28. In turn, second bar 86 is also pulled upwards leading to the rotation of pivot points 92 and 93 to move third bar 90 to the right. The movement of third bar 90 leads to the pivoting of pinch roller 72 around a pivot point 95 as indicated by the arrows in FIG. 4.

The end result is the lifting of pinch roller 72 to disengaged position 78 to facilitate loading of paper or other media between pinch roller 72 and feeder roller 74. After the media has been properly loaded, pinch roller 72 is placed in engaged position 76, which is accomplished simply by reversing the mechanical movements described above, by lowering media reel 28 to printing position 32. The sheet of media is thus secured between pinch roller 12 and feeder roller 74 to feed the media over platen 24 for printing. Printer 10 may therefore resume normal operation.

Figure 5:
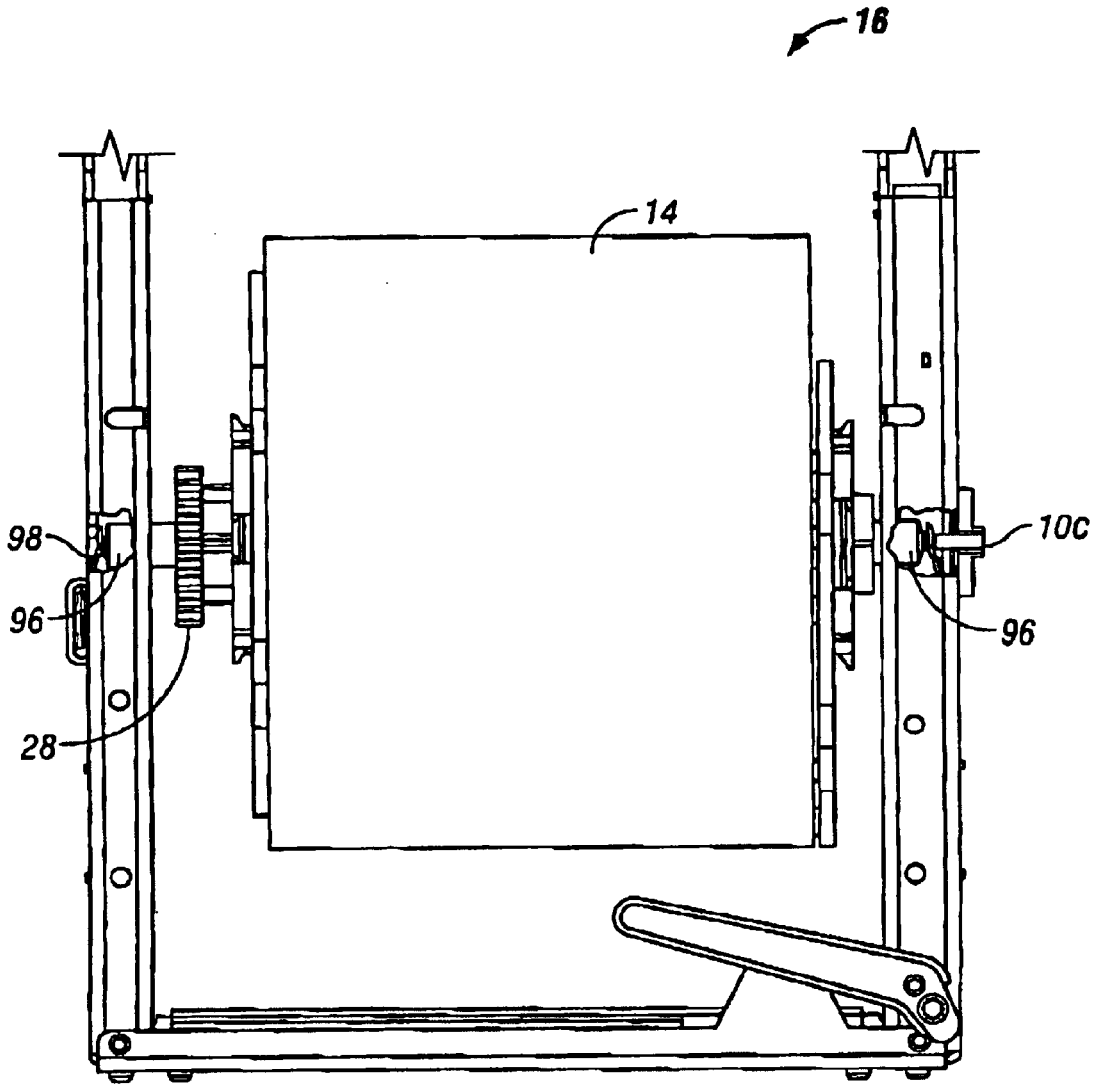
FIG. 5 is a top view of the media assembly in accordance with one embodiment of the present invention.

FIG. 5 is a top view of media assembly 16 in accordance with one embodiment of the present invention. As described above, media assembly 16 includes media reel 28 having internal reel motor 30 (not illustrated) for supporting and turning media roll 14. Media assembly 16 also includes a shaft 96 that extends through media roll 14 through an aperture of media reel 28. Shaft 96 is coupled to a spring 98 and a setting screw 100.

To ensure that the media sheet that is unrolled from media roll 14 is precisely centered over platen 24 without skew, setting screw 100 may be used to adjust media reel 28 either to a left side or to a right side of media assembly 16. When setting screw 100 is turned, its motion is compensated for by spring 98. If for example, setting screw 100 is turned to move media roll 14 to the right, spring 98 will push shaft 96 to the right until the adjustment is completed.

Figure 6:
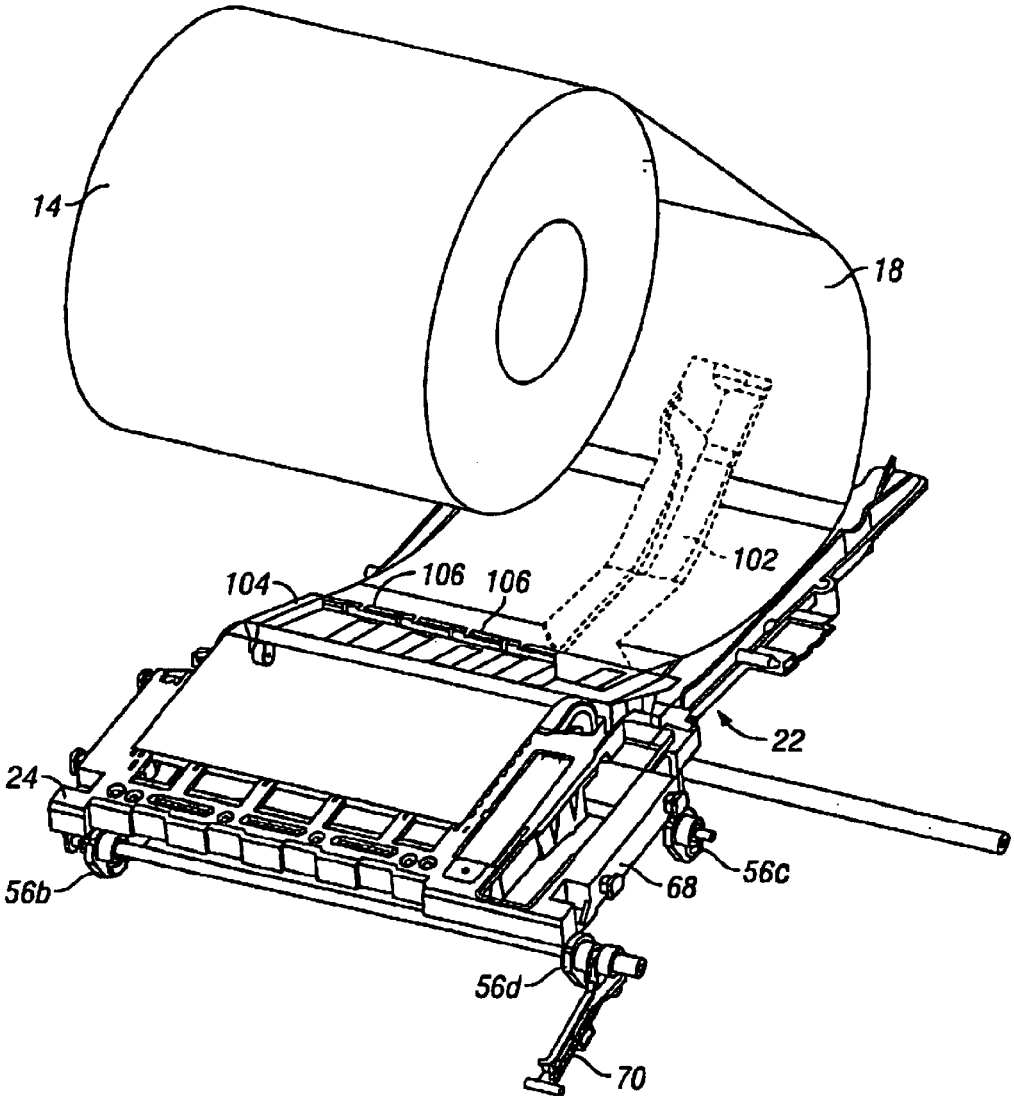
FIG. 6 is a rear view of printer in accordance with one embodiment of the present invention.

FIG. 6 is a rear view of printer 10 in accordance with one embodiment of the present invention. As described above, sheet of media 18 is unrolled from media roll 14 and fed into roller system 22 before being secured to platen 24 for printing. The PPS of printer 10 is then adjusted using cam system 26. Lever 70 is used to move the platen up or down so that the PPS is preferably about 1.3 mm. A movable media guide 102 and a fixed media guide 104 is used to guide media sheet 18 to roller system 22. Depending on the width of media sheet 18, movable guide 102 may be moved manually by a user to accommodate an edge of media sheet 18. Fixed media guide 104 is used to guide the other edge of media sheet 18. In addition, fixed media guide 104 includes a number of guide rollers 106 to ensure that media sheet 18 is secured.

Figure 7:
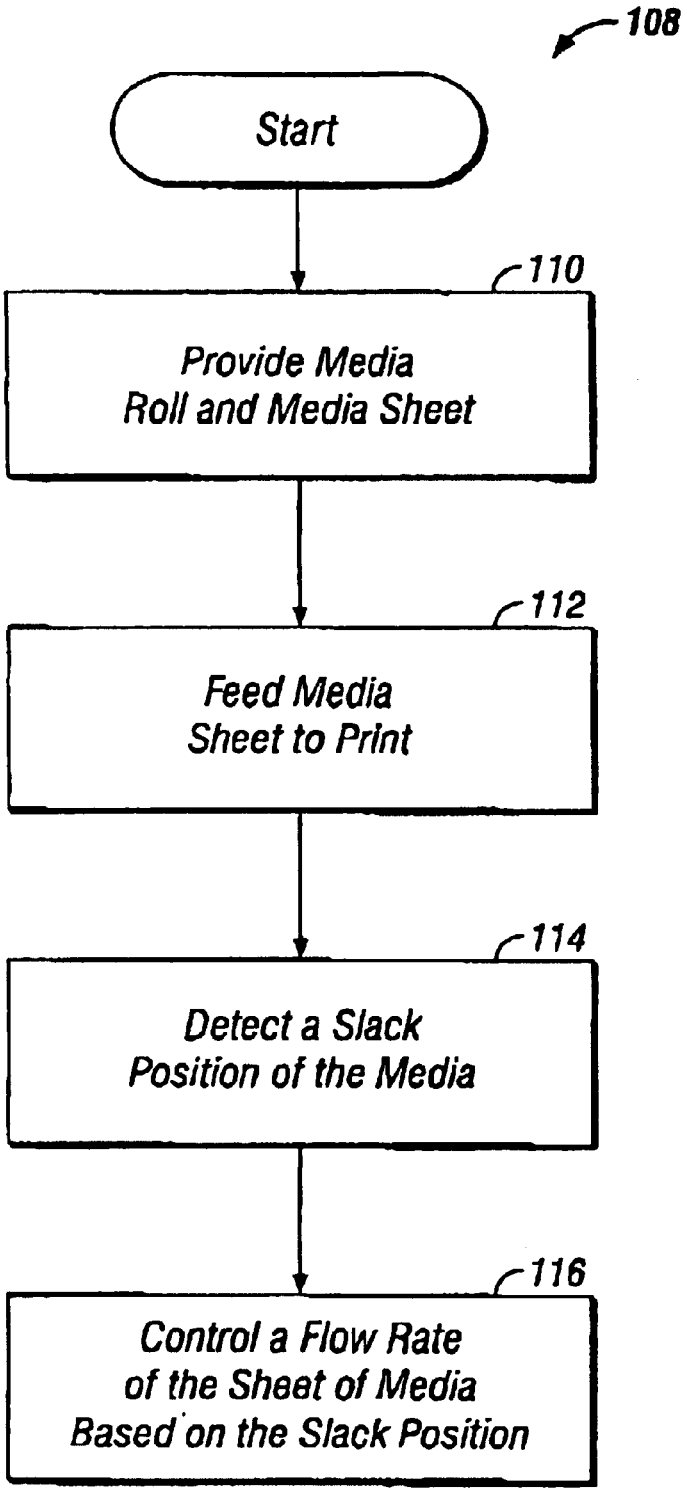
FIG. 7 is a flow chart of a method for handling media in a high-speed printer.

FIG. 7 is a flow chart of a method 108 for handling media in a high-speed printer. Method 108 begins at a block 110 by providing a media roll that is used to supply a sheet of media. The media sheet is fed into a print carriage for printing in a block 112. A slack position of the sheet of media is detected in a block 114. The slack position is preferably initialized to a neutral position after initialization, but changes immediately after printing has begun to a raised position. A flow rate of the sheet of media through the printer is then controlled based on the slack position of the sheet of media in a block 116. The higher the raised position, the higher the flow rate will be increased. If printing is stopped, then the flow rate will be stopped. If there is excess slack in the sheet of media, the flow rate is preferably controlled to a negative flow rate, thereby retracting the media sheet back into the media roll.

Other embodiments of the invention will be apparent to those skilled in the art from consideration of the specification and practice of the invention. Furthermore, certain terminology has been used for the purposes of descriptive clarity, and not to limit the present invention. The embodiments and preferred features described above should be considered exemplary, with the invention being defined by the appended claims.

What is claimed is:

1. A high-speed printer comprising: a feedback control system for receiving a sheet of media, wherein said feedback control system is to detect a slack position of said sheet of media; a media assembly for supporting a media roll for supplying said sheet of media to said feedback control system, wherein said media assembly is to control a flow rate of said sheet of media based on said slack position of said sheet of media; and a roller system for receiving said sheet of media from said feedback control system, wherein said roller system is to feed said sheet of media to a print carriage, wherein the feedback control system further comprises a tensioner having a first end and a second end, wherein said first end is pivotably coupled to a base of said printer and wherein said second end is coupled to the sheet of media, wherein said tensioner is pivotable to move said second end and the sheet of media to the slack position, and wherein the feedback control system further comprises: a codewheel coupled to the first end of the tensioner, wherein said codewheel comprises a first lowered marking, a neutral marking, and a first raised marking, wherein said codewheel and said first lowered marking, said neutral marking, and said first raised marking are to rotate when the tensioner is pivoted; and a sensor coupled to the base, wherein said sensor detects the first lowered marking when the slack position of said sheet of media is a first lowered position, wherein said sensor detects the neutral marking when the slack position is a neutral position, and wherein said sensor detects the first raised marking when the slack position is a first raised position.

2. The high-speed printer as recited in claim 1, wherein if the sensor detects the neutral marking, the media assembly system stops the flow rate of the sheet of media.

3. The high-speed printer as recited in claim 2, wherein if the sensor detects the first raised marking, the media assembly system increases the flow rate of the sheet of media relative to the flow rate of the sheet of media when the sensor detects the neutral marking.

4. The high-speed printer as recited in claim 3, wherein if the sensor detects the first lowered marking, the media assembly system retracts the sheet of media at a negative flow rate.

5. The high-speed printer as recited in claim 4, wherein if the sensor detects a second raised marking when the slack position of the sheet of media is a second raised position, the media assembly increases the flow rate of the sheet of media relative to the flow rate of the sheet of media when the sensor detects the first raised marking.

6. The high-speed printer as recited in claim 5, wherein if the sensor detects a second lowered marking when the slack position of the sheet of media is a second lowered position, the media assembly increases the negative flow rate of the sheet of media relative to the flow rate of the sheet of media when the sensor detects the first lowered marking.

7. A method for handling media in a high-speed printer, comprising: providing a media roll for supplying a sheet of media; feeding said sheet of media to a print carriage for printing; detecting a slack position of said sheet of media; and controlling a flow rate of said sheet of media based on said slack position of said sheet of media, wherein if the slack position detected is a neutral position, controlling the flow rate of the sheet of media by stopping the flow rate, wherein if the slack position detected is a first raised position, controlling the flow rate of the sheet of media by increasing the flow rate relative to the flow rate maintained when a neutral position is detected, and wherein if the slack position detected is a first lowered position, controlling the flow rate of the sheet of media by retracting the sheet of media, thereby generating a negative flow rate.

8. The method for handling media as recited in claim 7, further comprising: supporting the sheet of media under the print carriage with a platen; and adjusting said platen with a cam system to adjust a pen to paper spacing between the sheet of media and the print carriage.

9. The method for handling media as recited in claim 8, wherein the pen to paper spacing is about 1.3 mm.

* * * * *